US008573301B2

(12) United States Patent
Barbee

(10) Patent No.: US 8,573,301 B2
(45) **Date of Patent: *Nov. 5, 2013**

(54) METHOD AND APPARATUS FOR DROPPING A PUMP DOWN PLUG OR BALL

(75) Inventor: Phil Barbee, Gretna, LA (US)

(73) Assignee: Gulfstream Services, Inc., Houma, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/545,675

(22) Filed: Jul. 10, 2012

(65) Prior Publication Data

US 2013/0146310 A1 Jun. 13, 2013

Related U.S. Application Data

(63) Continuation of application No. 12/956,331, filed on Nov. 30, 2010, now Pat. No. 8,215,396, which is a continuation of application No. 11/951,802, filed on Dec. 6, 2007, now Pat. No. 7,841,410, which is a continuation-in-part of application No. 11/749,591, filed on May 16, 2007, now Pat. No. 7,607,481.

(51) Int. Cl.
*E21B 33/16* (2006.01)

(52) U.S. Cl.
USPC ..... 166/291; 166/70; 166/75.15; 166/177.4; 166/383

(58) Field of Classification Search
USPC ..... 166/70, 75.15, 177.4, 291, 383
See application file for complete search history.

(56) References Cited

U.S. PATENT DOCUMENTS 3,828,852 A 8/1974 Delano
4,345,651 A 8/1982 Akkerman et al.
4,427,065 A 1/1984 Watson
4,624,312 A 11/1986 McMullin
4,671,353 A 6/1987 Daming
4,674,573 A 6/1987 Bode
4,722,389 A 2/1988 Arnold
4,782,894 A 11/1988 LaFleur
4,854,383 A 8/1989 Arnold et al.
4,995,457 A 2/1991 Baldridge
5,095,988 A 3/1992 Bode
5,236,035 A 8/1993 Brisco et al.
5,293,933 A 3/1994 Brisco
5,435,390 A 7/1995 Baugh et al.
5,443,122 A 8/1995 Brisco
5,758,726 A 6/1998 Streich et al.
5,833,002 A 11/1998 Holcombe
5,856,790 A 1/1999 Baugh et al.
5,960,881 A 10/1999 Allamon et al.
6,142,226 A 11/2000 Vick
6,182,752 B1 2/2001 Smith, Jr. et al.
6,390,200 B1 5/2002 Allamon et al.
6,575,238 B1 6/2003 Yokley
6,672,384 B2 1/2004 Pedersen et al.
6,715,541 B2 4/2004 Pedersen et al.
6,904,970 B2 6/2005 Simson
7,066,249 B2 6/2006 Simson
7,607,481 B2 10/2009 Barbee
7,841,410 B2 11/2010 Barbee
8,215,396 B2 7/2012 Barbee

*Primary Examiner* — William P Neuder

(74) *Attorney, Agent, or Firm* — Garvey, Smith, Nehrbass & North, L.L.C.; Charles C. Garvey, Jr.; Vanessa M. D'Souza

(57) ABSTRACT

An improved method and apparatus for dropping a ball, plug or dart during oil and gas well operations (e.g., cementing operations) employs a specially configured valving member with curved and flat portions that alternatively direct fluid flow through a bore or opening in the valving member via an inner channel or around the periphery of the valving member in an outer channel. In one embodiment, the ball(s), dart(s) or plug(s) are contained in a sliding sleeve that shifts position responsive to valve rotation.

34 Claims, 17 Drawing Sheets

METHOD AND APPARATUS FOR DROPPING A PUMP DOWN PLUG OR BALL

CROSS-REFERENCE TO RELATED APPLICATIONS

This is a continuation of U.S. patent application Ser. No. 12/956,331, filed Nov. 30, 2010 (issuing as U.S. Pat. No. 8,215,396 on 10 Jul. 2012), which is a continuation of U.S. patent application Ser. No. 11/951,802, filed 6 Dec. 2007 (issued as U.S. Pat. No. 7,841,410 on 30 Nov. 2010), which is a continuation in part of co-pending U.S. patent application Ser. No. 11/749,591, filed 16 May 2007 (issued as U.S. Pat. No. 7,607,481 on 27 Oct. 2009), each of which is hereby incorporated herein by reference and to which priority is hereby claimed.

U.S. patent application Ser. No. 12/349,109, filed 6 Jan. 2009 (issued as U.S. Pat. No. 7,918,278 on 5 Apr. 2011), is hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a method and apparatus that is of particular utility in cementing operations associated with oil and gas well exploration and production. More specifically the present invention provides an improvement to cementing operations and related operations employing a plug or ball dropping head.

2. General Background of the Invention

Patents have issued that relate generally to the concept of using a plug, dart or a ball that is dispensed or dropped into the well or "down hole" during oil and gas well drilling and production operations, especially when conducting cementing operations. The following possibly relevant patents are incorporated herein by reference. The patents are listed numerically. The order of such listing does not have any significance.

TABLE

| PATENT NO. | TITLE | ISSUE DATE |
|---|---|---|
| 3,828,852 | Apparatus for Cementing Well Bore Casing | Aug. 13, 1974 |
| 4,427,065 | Cementing Plug Container and Method of Use Thereof | Jan. 24, 1984 |
| 4,624,312 | Remote Cementing Plug Launching System | Nov. 25, 1986 |
| 4,671,353 | Apparatus for Releasing a Cementing Plug | Jun. 9, 1987 |
| 4,722,389 | Well Bore Servicing Arrangement | Feb. 2, 1988 |
| 4,782,894 | Cementing Plug Container with Remote Control System | Nov. 8, 1988 |
| 4,854,383 | Manifold Arrangement for use with a Top Drive Power Unit | Aug. 8, 1989 |
| 4,995,457 | Lift-Through Head and Swivel | Feb. 26, 1991 |
| 5,095,988 | Plug Injection Method and Apparatus | Mar. 17, 1992 |
| 5,236,035 | Swivel Cementing Head with Manifold Assembly | Aug. 17, 1993 |
| 5,293,933 | Swivel Cementing Head with Manifold Assembly Having Remove Control Valves and Plug Release Plungers | Mar. 15, 1994 |

TABLE-continued

| PATENT NO. | TITLE | ISSUE DATE |
|---|---|---|
| 5,435,390 | Remote Control for a Plug-Dropping Head | Jul. 25, 1995 |
| 5,758,726 | Ball Drop Head With Rotating Rings | Jun. 2, 1998 |
| 5,833,002 | Remote Control Plug-Dropping Head | Nov. 10, 1998 |
| 5,856,790 | Remote Control for a Plug-Dropping Head | Jan. 5, 1999 |
| 5,960,881 | Downhole Surge Pressure Reduction System and Method of Use | Oct. 5, 1999 |
| 6,142,226 | Hydraulic Setting Tool | Nov. 7, 2000 |
| 6,182,752 | Multi-Port Cementing Head | Feb. 6, 2001 |
| 6,390,200 | Drop Ball Sub and System of Use | May 21, 2002 |
| 6,575,238 | Ball and Plug Dropping Head | Jun. 10, 2003 |
| 6,672,384 | Plug-Dropping Container for Releasing a Plug Into a Wellbore | Jan. 6, 2004 |
| 6,904,970 | Cementing Manifold Assembly | Jun. 14, 2005 |
| 7,066,249 | Cementing Manifold Assembly | Jul. 27, 2006 |

BRIEF SUMMARY OF THE INVENTION

The present invention provides an improved method and apparatus for use in cementing and like operations, employing a plug or ball dropping head of improved configuration.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 9:
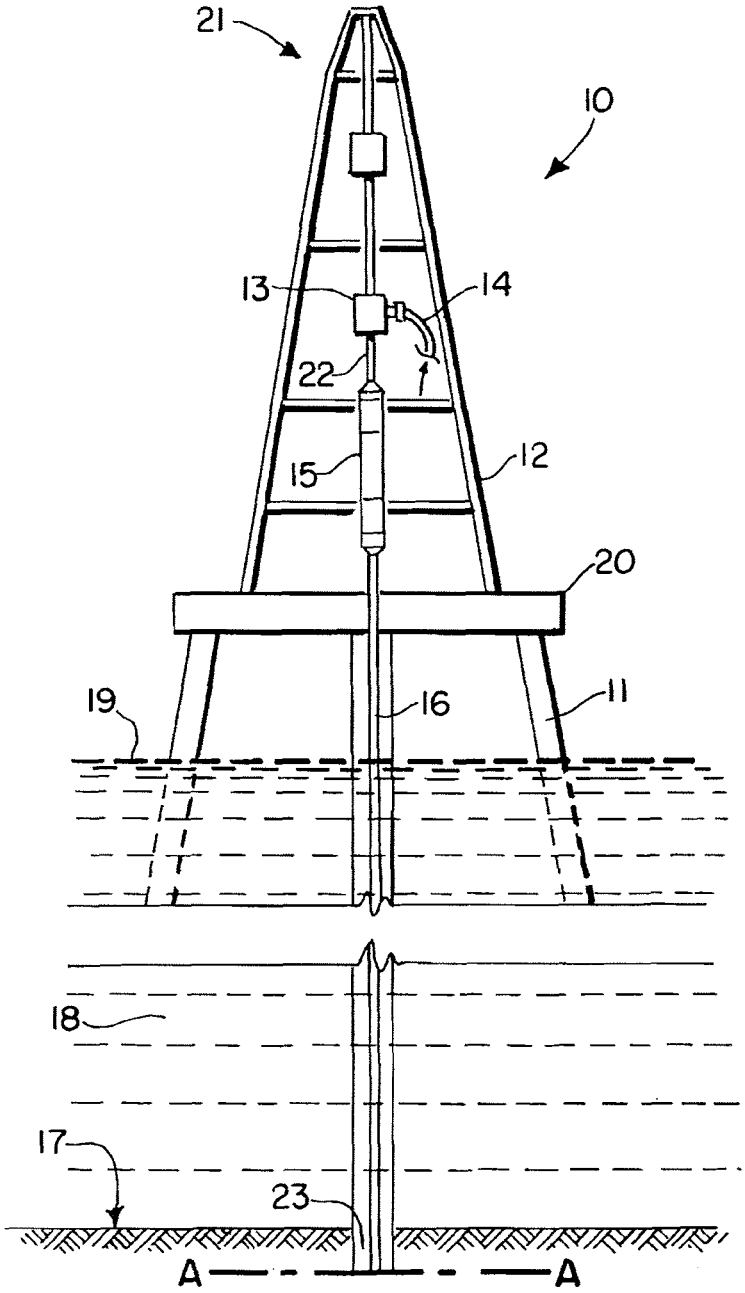
FIG. 9 is an elevation view of a preferred embodiment of the apparatus of the present invention and illustrating the method of the present invention.

FIG. 9 shows generally an oil well drilling structure 10 that can provide a platform 11 such as a marine platform as shown. Such platforms are well known. Platform 11 supports a derrick 12 that can be equipped with a lifting device 21 that supports a top drive unit 13. Such a derrick 12 and top drive unit 13 are well known. A top drive unit can be seen for example in U.S. Pat. Nos. 4,854,383 and 4,722,389 which are incorporated herein by reference.

A flow line 14 can be used for providing a selected fluid such as a fluidized cement or fluidized setable material to be pumped into the well during operations which are known in the industry and are sometimes referred to as cementing operations. Such cementing operations are discussed for example in prior U.S. Pat. Nos. 3,828,852; 4,427,065; 4,671,353; 4,782,894; 4,995,457; 5,236,035; 5,293,933; and 6,182,752, each of which is incorporated herein by reference.

A tubular member 22 can be used to support plug dropping head 15 at a position below top drive unit 13 as shown in FIG. 9. String 16 is attached to the lower end portion of plug dropping head 15.

In FIG. 9, the platform 11 can be any oil and gas well drilling platform such as a marine platform shown in a body of water 18 that provides a seabed or mud line 17 and water surface 19. Such a platform 11 provides a platform deck 20 that affords space for well personnel to operate and for the storage of necessary equipment and supplies that are needed for the well drilling operation.

Figure 10:
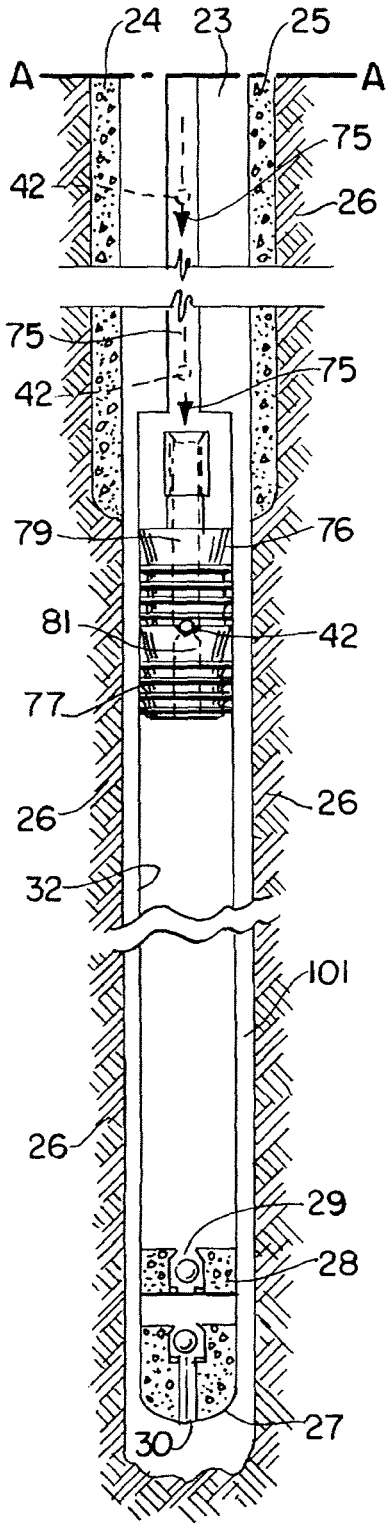
FIG. 10 is a sectional elevation view illustrating part of the method of the present invention and wherein line A-A of FIG. 10 matches line A-A of FIG. 9.
Figure 11:
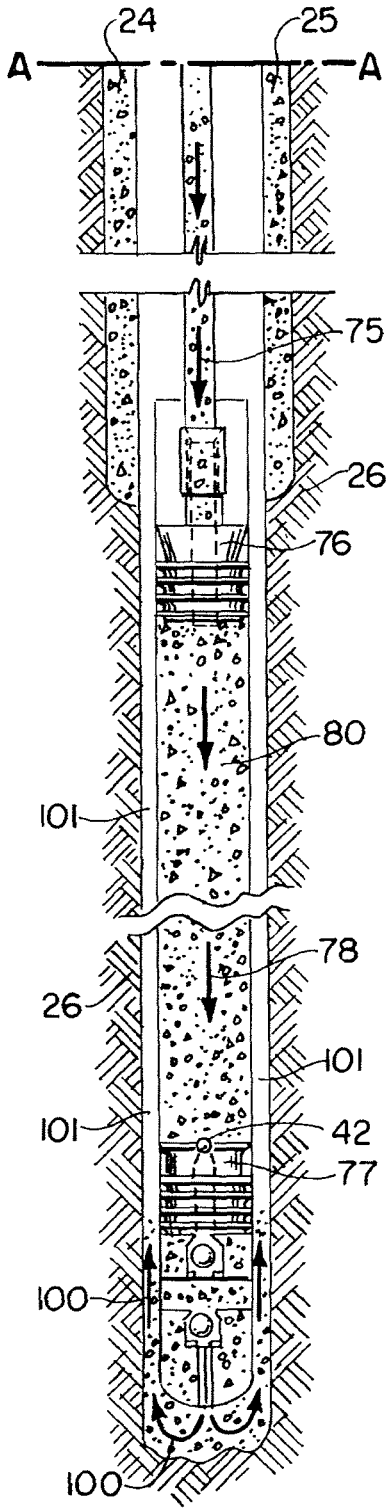
FIG. 11 is a sectional elevation view illustrating part of the method of the present invention and wherein line A-A of FIG. 11 matches line A-A of FIG. 9.

A well bore 23 extends below mud line 17. In FIGS. 10 and 11, the well bore 23 can be surrounded with a surface casing 24. The surface casing 24 can be surrounded with cement/concrete 25 that is positioned in between a surrounding formation 26 and the surface casing 24. Similarly, a liner or production casing 32 extends below surface casing 24. The production casing 32 has a lower end portion that can be fitted with a casing shoe 27 and float valve 28 as shown in FIGS. 10-16. Casing shoe 27 has passageway 30. Float valve 28 has passageway 29.

Figure 1A:
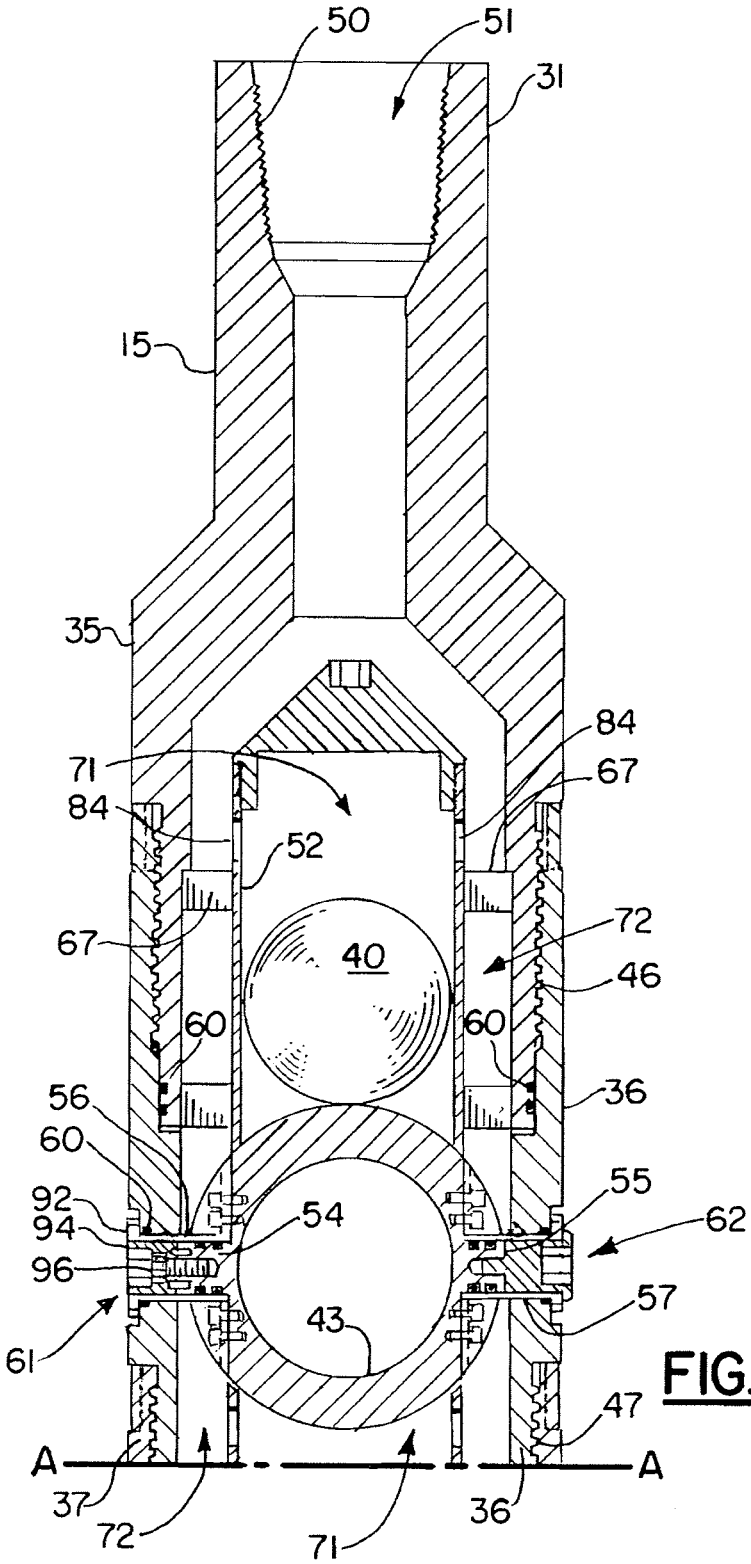
FIGS. 1A, 1B, 1C are partial sectional elevation views of a preferred embodiment of the apparatus of the present invention wherein line A-A of FIG. 1A matches line A-A of FIG. 1B, and line B-B of FIG. 1B matches line B-B of FIG. 1C.
Figure 1B:
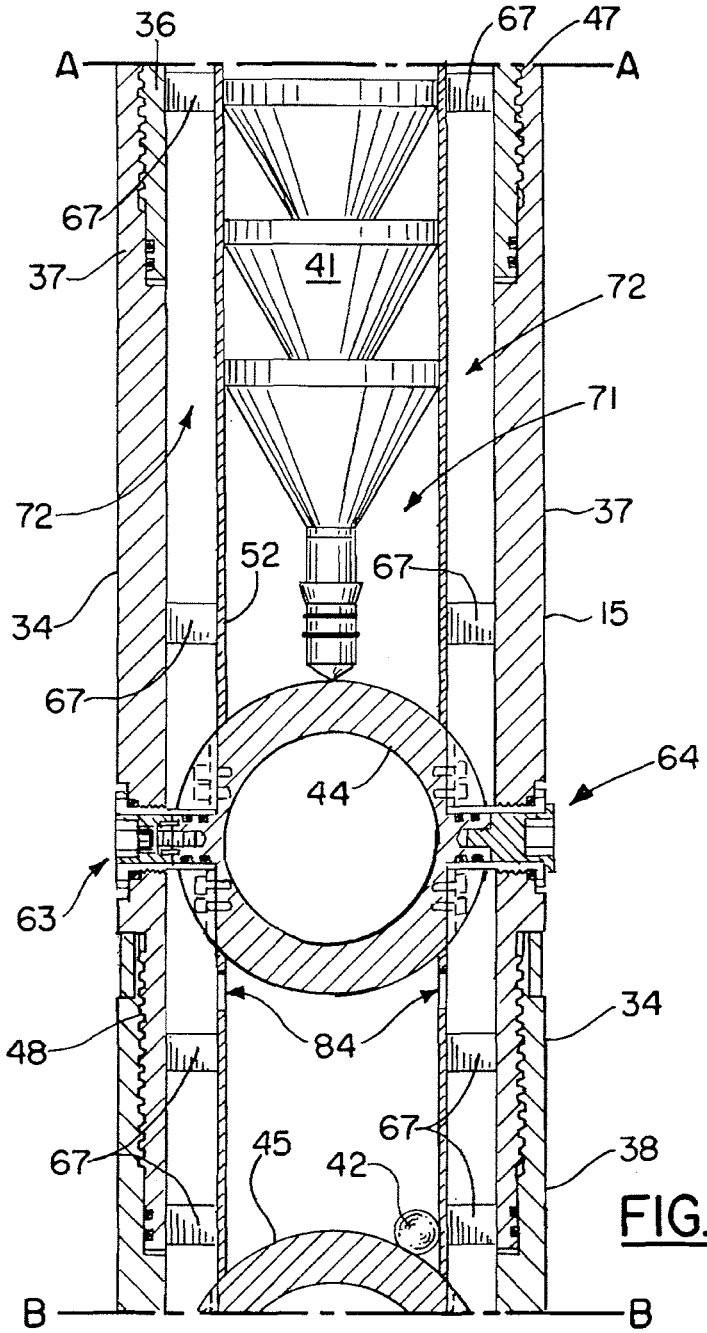
Figure 1C:
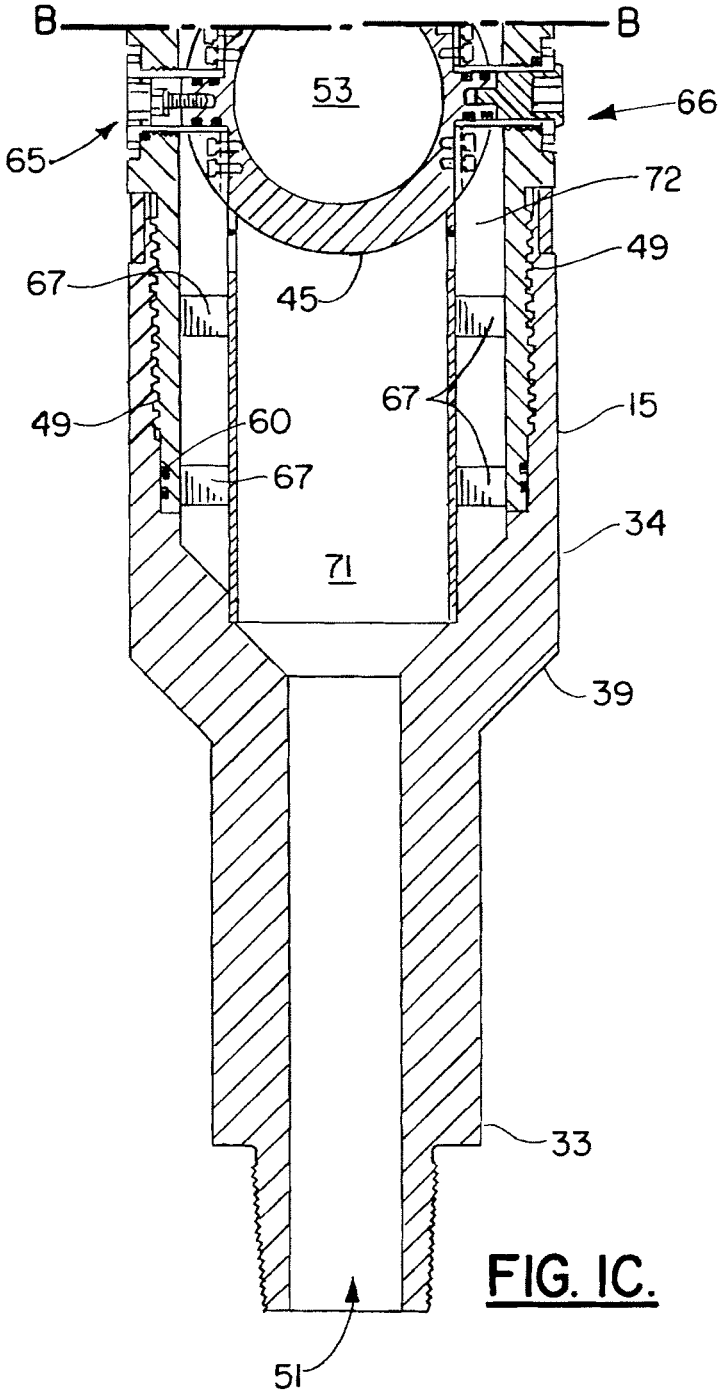
Figure 2:
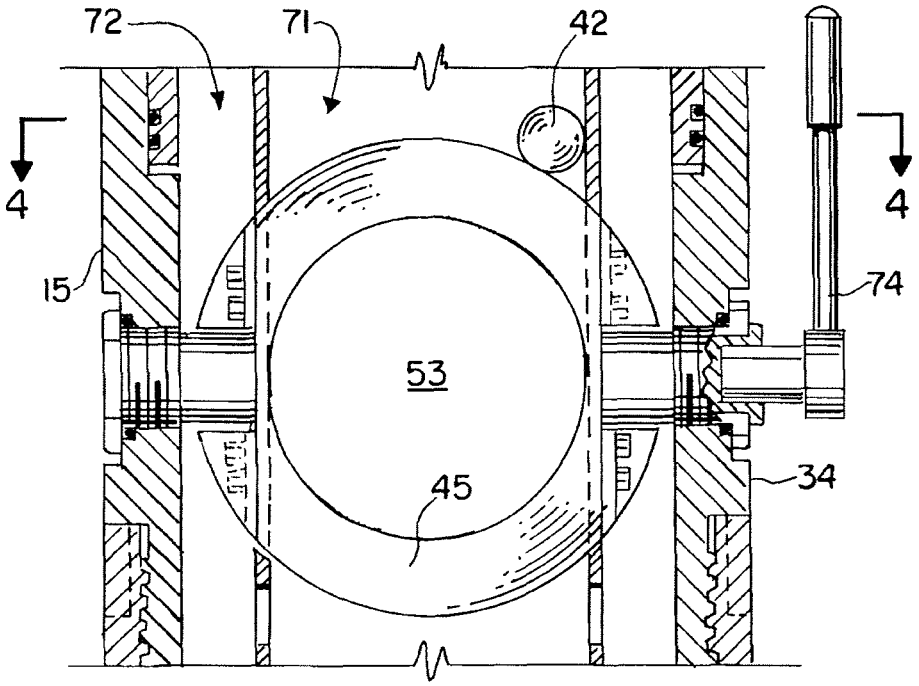
FIG. 2 is a partial, sectional, elevation view of a preferred embodiment of the apparatus of the present invention.

The present invention provides an improved method and apparatus for dropping balls, plugs, darts or the like as a part of a cementing operation. Such cementing operations are in general known and are employed for example when installing a liner such as liner 32. In the drawings, arrows 75 indicate generally the flow path of fluid (e.g. cement, fluidized material or the like) through the tool body 34. In that regard, the present invention provides an improved ball or plug or dart dropping head 15 that is shown in FIGS. 1-8 and 10-17. In FIGS. 1A, 1B, 1C and 2-8, ball/plug dropping head 15 has an upper end portion 31 and a lower end portion 33. Ball/plug dropping head 15 provides a tool body 34 that can be of multiple sections that are connected together, such as with threaded connections. In FIGS. 1A-1C, the tool body 34 includes sections 35, 36, 37, 38, 39. The section 35 is an upper section. The section 39 is a lower section.

Ball/plug dropping head 15 can be pre-loaded with a number of different items to be dropped as part of a cementing operation. For example, in FIGS. 1A, 1B, 1C there are a number of items that are contained in ball/plug dropping head 15. These include an upper, larger diameter ball dart 40, 41 and smaller diameter ball 42. In FIGS. 18-26, an alternate embodiment is shown which enables very small diameter balls, sometimes referred to as "frac-balls" 102 (which can have a diameter of between about ½ and ⅝ inches) to be dispensed into the well below toll body 34.

The tool body 34 supports a plurality of valving members at opposed openings 90. The valving members can include first valving member 43 which is an upper valving member. The valving members can include a second valving member 44 which is in between the first valving member 43 and a lower or third valving member 45. Valving member 43 attaches to tool body 34 at upper opening positions 61, 62. Valving member 44 attaches to tool body 34 at middle opening positions 63, 64. Valving member 45 attaches to tool body 43 at lower opening positions 65, 66.

Threaded connections 46, 47, 48, 49 can be used for connecting the various body sections 35, 36, 37, 38, 39 together end to end as shown in FIGS. 1A, 1B, 1C. Tool body 34 upper end 31 is provided with an internally threaded portion 50 for forming a connection with tubular member 22 that depends from top drive unit 13 as shown in FIG. 9. A flow bore 51 extends between upper end 31 and lower end 33 of tool body 34.

Sleeve sections 52 are secured to tool body 34 within bore 15 as shown in FIGS. 1A, 1B, 1C. Sleeves 52 can be generally centered within bore 51 as shown in FIGS. 1A, 1B, 1C using spacers 67 that extend along radial lines from the sections 35-39.

Each valving member 43, 44, 45 is movable between open and closed positions. In FIGS. 1A, 1B, 1C each of the valving members 43, 44, 45 is in a closed position. In that closed position, each valving member 43, 44, 45 prevents downward movement of a plug, ball 40, 42, or dart 41 as shown. In FIG. 1A, the closed position of valving member 43 prevents downward movement of larger diameter ball 40. Similarly, in FIG. 1B, a closed position of valving member 44 prevents a downward movement of dart 41. In FIG. 1B, a closed position of valving member 45 prevents a downward movement of smaller diameter ball 42. In each instance, the ball, dart or plug rests upon the outer curved surface 68 of valving member 43, 44 or 45 as shown in the drawings.

Figure 3:
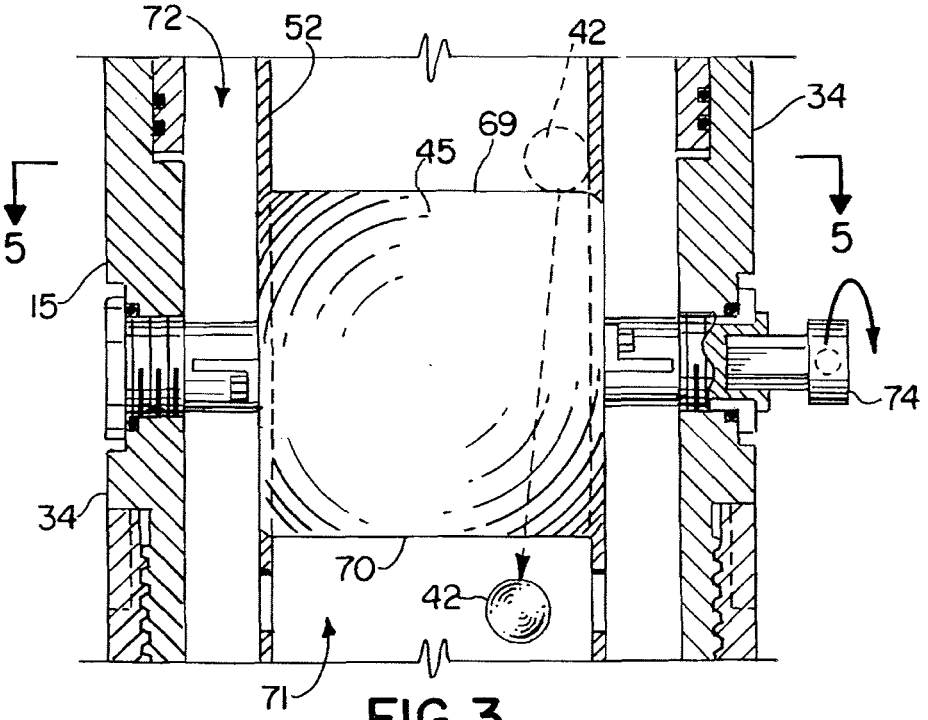
FIG. 3 is a partial, sectional, elevation view of a preferred embodiment of the apparatus of the present invention.
Figure 6:
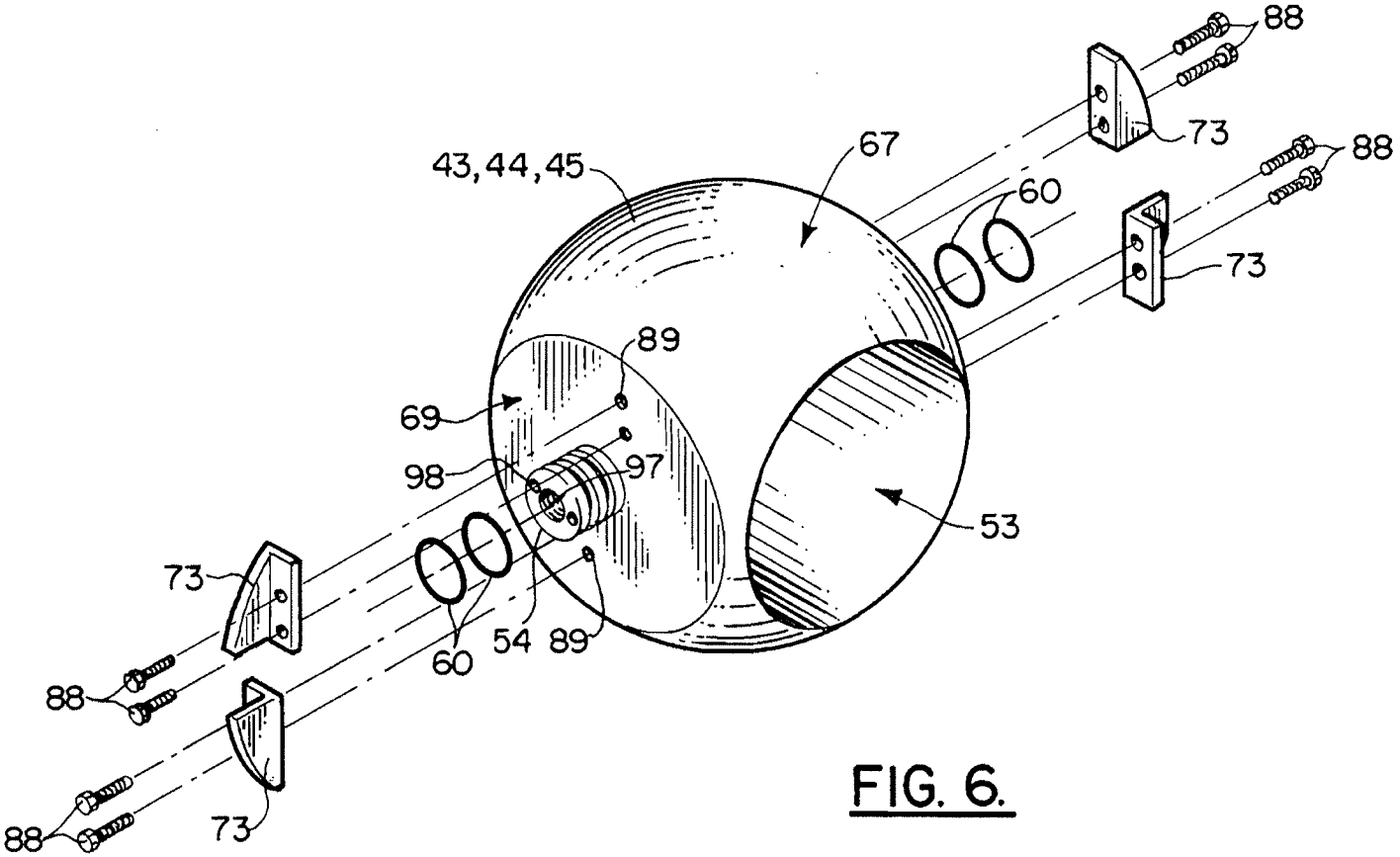
FIG. 6 is a partial perspective view of a preferred embodiment of the apparatus of the present invention.
Figure 17:
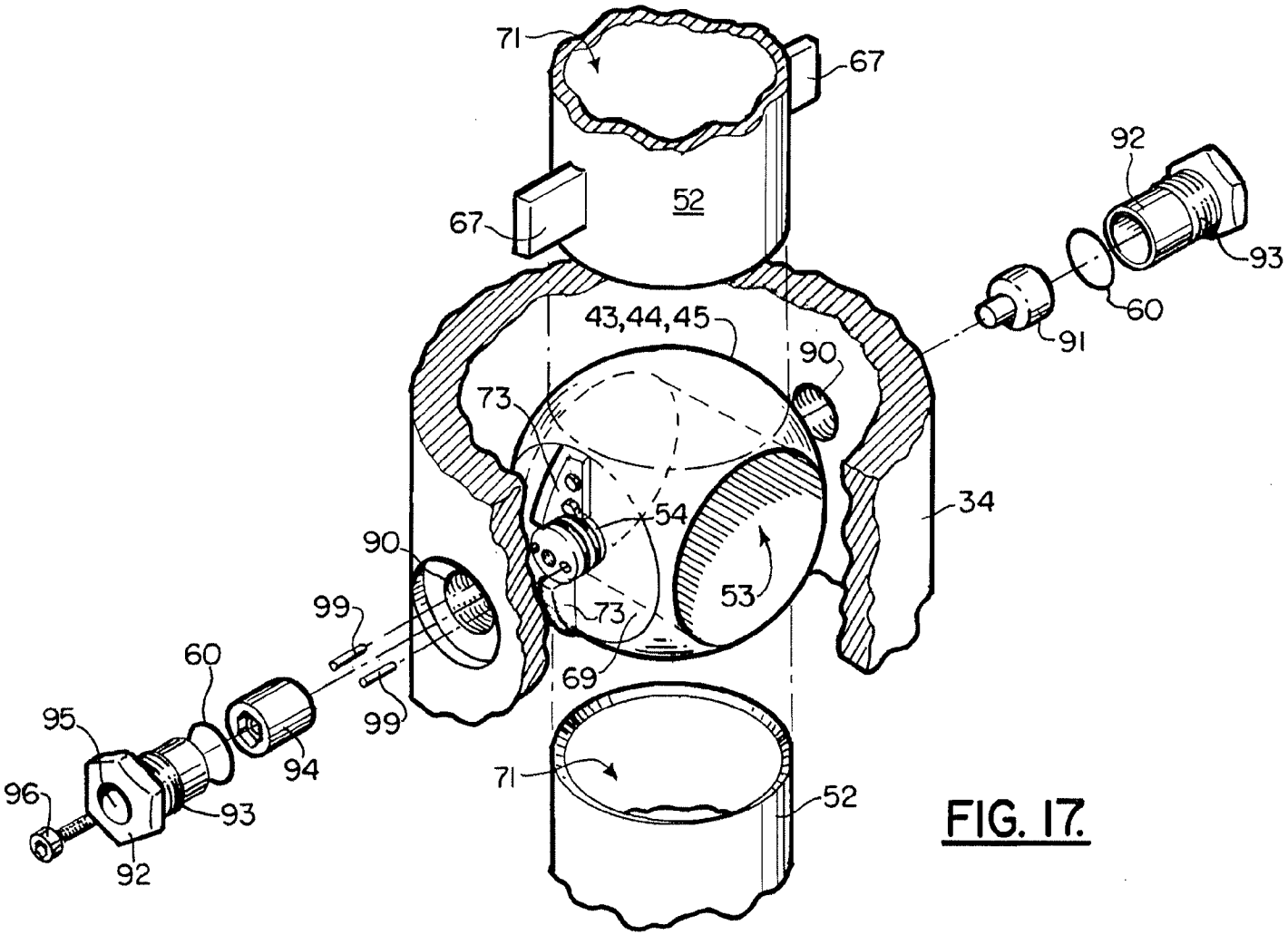
FIG. 17 is a partial perspective view of a preferred embodiment of the apparatus of the present invention.
Figure 18:
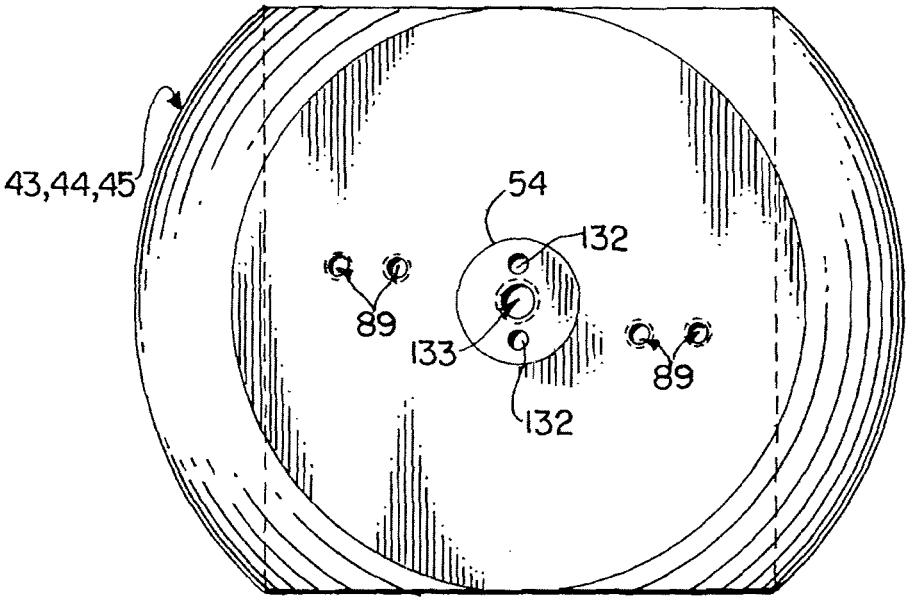
FIG. 18 is a partial view of a preferred embodiment of the apparatus of the present invention and showing a ball valving member.

Each valving member 43, 44, 45 provides a pair of opposed generally flat surfaces 69, 70 (see FIGS. 3, 6, 17). FIG. 17 shows in more detail the connection that is formed between each of the valving members 43, 44, 45 and the tool body 34. The tool body 34 provides opposed openings 90 that are receptive the generally cylindrically shaped valve stems 54, 55 that are provided on the flat sections or flat surfaces 69, 70 of each valving member 43, 44, 45. For example, in FIGS. 6 and 17, the flat surface 69 provides valve stem 54. Openings 90 are receptive of the parts shown in exploded view in FIG. 17 that enable a connection to be formed between the valving member 43, 44 or 45 and the tool body 34. For the stem 55, fastener 91 engages an internally threaded opening of stem 55. Bushing 92 is positioned within opening 90 and the outer surface of stem 55 registers within the central bore 95 of bushing 92. Bushing 92 is externally threaded at 93 for engaging a correspondingly internally threaded portion of tool body 34 at opening 90. O-rings 60 can be used to interface between stem 55 and bushing 92. A slightly different configuration is provided for attaching stem 54 to tool body 34. Sleeve 94 occupies a position that surrounds stem 54. Sleeve 54 fits inside of bore 95 of bushing 92. The externally threaded portion 93 of bushing 92 engages correspondingly shaped threads of opening 90. Pins 99 form a connection between the stem 54 at openings 98 and the sleeve 94. Fastener 96 forms a connection between bushing 92 and an internally threaded opening 97 of stem 54. As assembled, this configuration can be seen in FIG. 1A for example. The flat surfaces 69, 70 enable fluid to flow in bore 51 in a position radially outwardly or externally of sleeve or sleeve section 52 by passing between the tool body sections 35, 36, 37, 38, 39 and sleeve 52. Thus, bore 51 is divided into two flow channels. These two flow channels 71, 72 include a central flow channel 71 within sleeves 52 that is generally cylindrically shaped and that aligns generally with the channel 53 of each valving member 43, 44, 45. The second flow channel is an annular outer flow channel 72 that is positioned in between a sleeve 52 and the tool body sections 35, 36, 37, 38, 39. The channels 71, 72 can be concentric. The outer channel 72 is open when the valving members 43, 44, 45 are in the closed positions of FIGS. 1A, 1B and 1C, wherein central flow channel 71 is closed.

Figure 4:
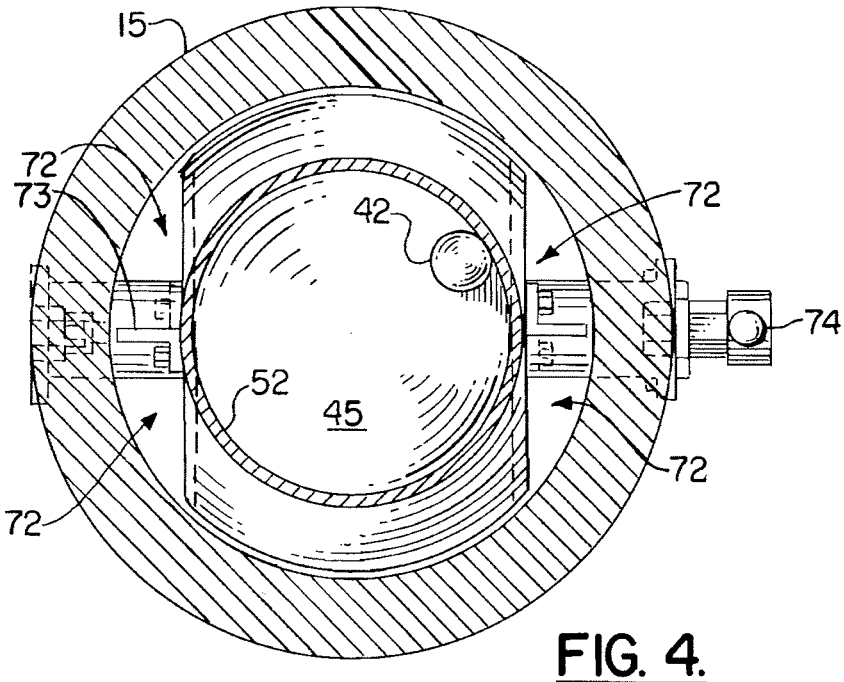
FIG. 4 is a sectional view taken long lines 4-4 of FIG. 2.
Figure 5:
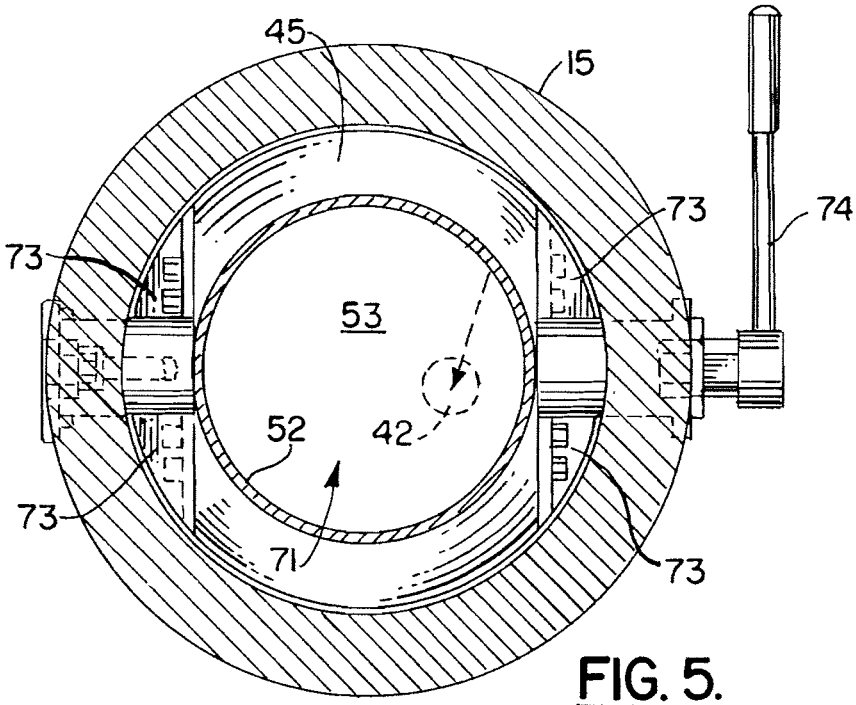
FIG. 5 is a sectional view taken along lines 5-5 of FIG. 3.

When the valving members 43, 44, 45 are rotated to a closed position, fins 73 become transversely positioned with respect to the flow path of fluid flowing in channel 72 thus closing outer flow channel 72 (see FIG. 5). This occurs when a valving member 43, 44, 45 is opened for releasing a ball 40 or 42 or for releasing dart 41. FIG. 4 illustrates a closed position (FIG. 4) of the valving member 45 just before releasing smaller diameter ball 42. Fins 73 are generally aligned with bore 15 and with flow channels 71, 72 when flow in channel 72 is desired (FIG. 4). In FIG. 4, valving member 45 is closed and outer flow channel 72 is open.

Figure 7:
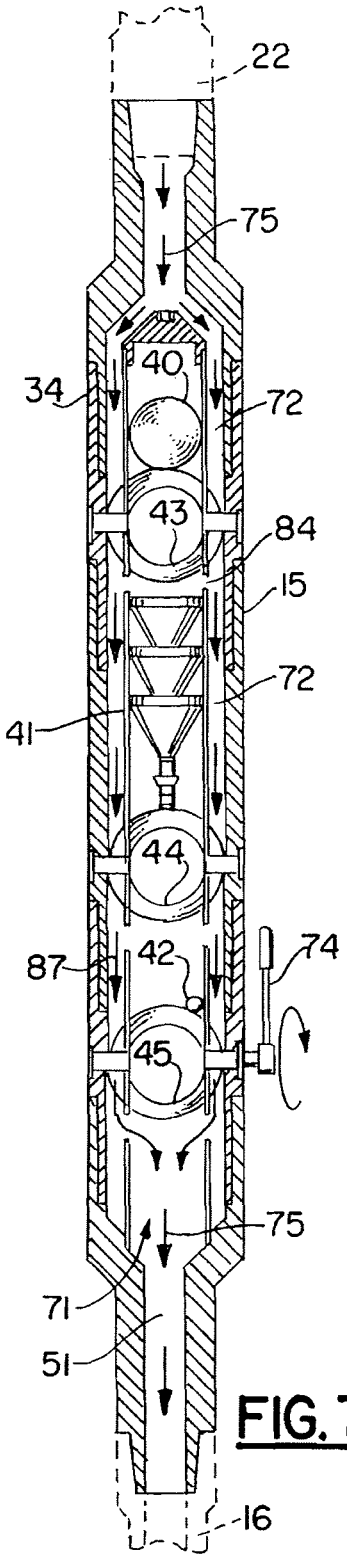
FIG. 7 is a sectional elevation view of a preferred embodiment of the apparatus of the present invention and illustrating a method step of the present invention.
Figure 8:
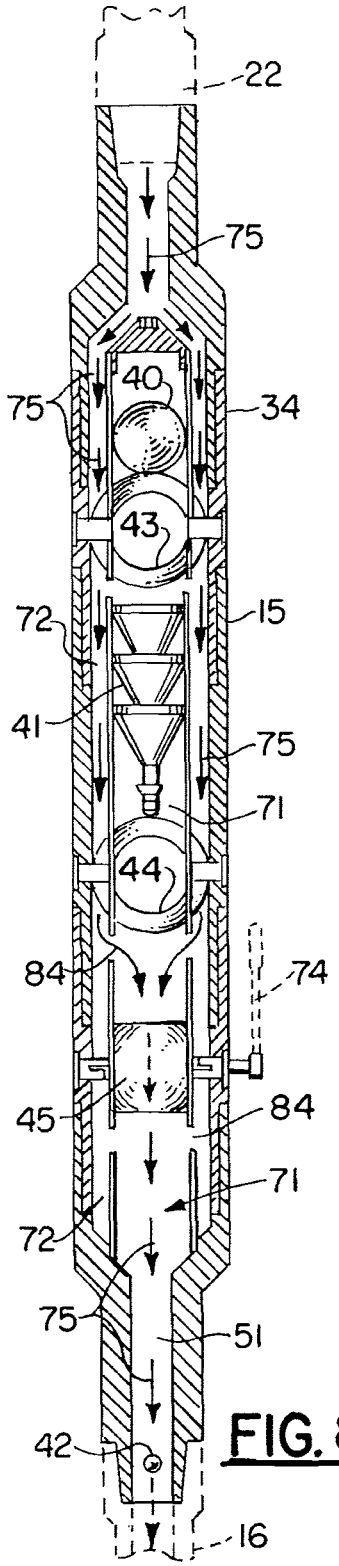
FIG. 8 is a sectional elevation view of a preferred embodiment of the apparatus of the present invention and illustrating a method step of the present invention.

In FIGS. 2-3, 5 and 7-8, a tool 74 has been used to rotate valving member 45 to an open position that aligns its channel 53 with central flow channel 71 enabling smaller diameter ball 42 to fall downwardly via central flow channel 71 (FIG. 8). In FIG. 5, outer flow channel 72 has been closed by fins 73 that have now rotated about 90 degrees from the open position of FIG. 4 to the closed position. Fins 73 close channel 72 in FIG. 5. It should be understood that tool 74 can also be used to rotate valving member 44 from an open position of FIG. 1B to a closed position such as is shown in FIG. 5 when it is desired that dart 41 should drop. Similarly, tool 74 can be used to rotate upper valving member 43 from the closed position of FIG. 1A to an open position such as is shown in FIG. 5 when it is desired to drop larger diameter ball 40.

FIGS. 7-16 illustrate further the method and apparatus of the present invention. In FIG. 8, lower or third valving member 45 has been opened as shown in FIG. 5 releasing smaller diameter ball 42. In FIG. 8, smaller diameter ball 42 is shown dropping wherein it is in phantom lines, its path indicated schematically by arrows 75.

FIG. 10 shows a pair of commercially available, known plugs 76, 77. These plugs 76, 77 include upper plug 76 and lower plug 77. Each of the plugs 76, 77 can be provided with a flow passage 79, 81 respectively that enables fluid to circulate through it before ball 42 forms a seal upon the flow passage 81. Smaller diameter ball 42 has seated upon the lower plug 77 in FIG. 10 so that it can now be pumped downwardly, pushing cement 80 ahead of it. In FIG. 11, arrows 78 schematically illustrate the downward movement of lower plug 77 when urged downwardly by a pumped substance such as a pumpable cement or like material 80. Each of the plugs 76, 77 can be provided with a flow passage 79, 81 respectively that enables fluid to circulate through it before ball 42 forms a seal upon the flow passage 81 (see FIG. 11). When plug 77 reaches float valve 28, pressure can be increased to push ball 42 through plug 77, float valve 28 and casing shoe 27 so that the cement flows (see arrows 100, FIG. 11) into the space 101 between formation 26 and casing 32.

Figure 12:
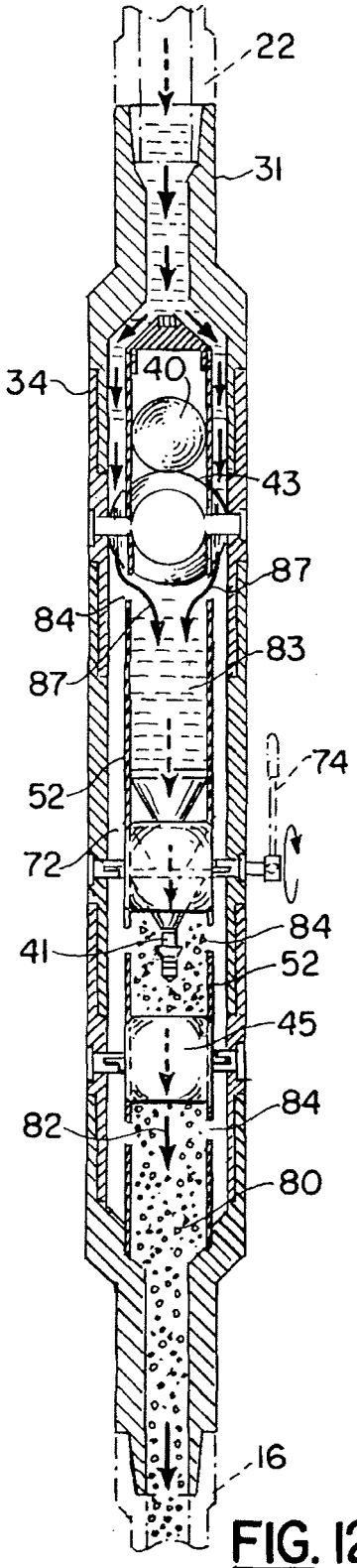
FIG. 12 is a sectional elevation view illustrating part of the method of the present invention.
Figure 13:
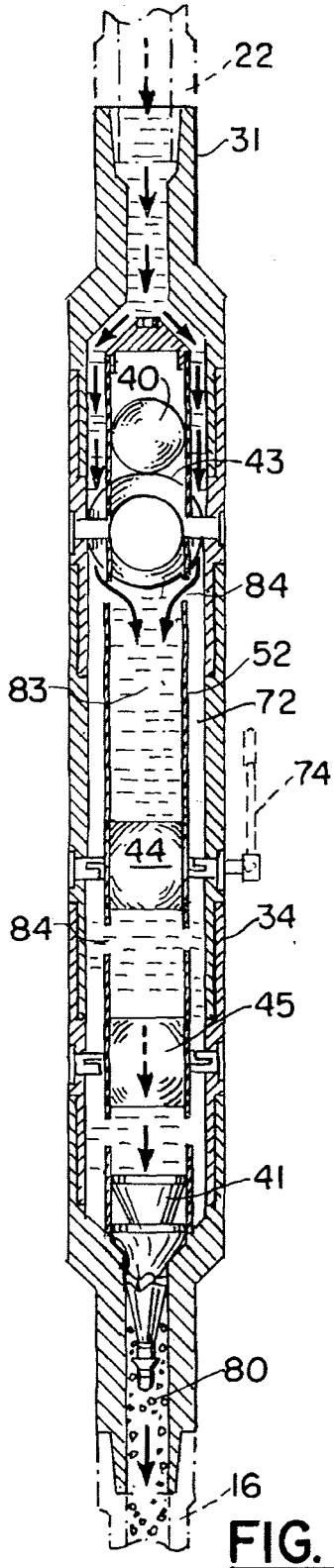
FIG. 13 is a sectional elevation view illustrating part of the method of the present invention.

In FIG. 12, second valving member 44 is opened releasing dart 41. Dart 41 can be used to push the cement 80 downwardly in the direction of arrows 82. A completion fluid or other fluid 83 can be used to pump dart 41 downwardly, pushing cement 80 ahead of it. Once valves 44 and 45 are opened, fluid 83 can flow through openings 84 provided in sleeves 52 below the opened valving member (see FIG. 7) as illustrated in FIGS. 7 and 12. Thus, as each valving member 43 or 44 or 45 is opened, fluid moves through the openings 84 into central flow channel 71.

Figure 14:
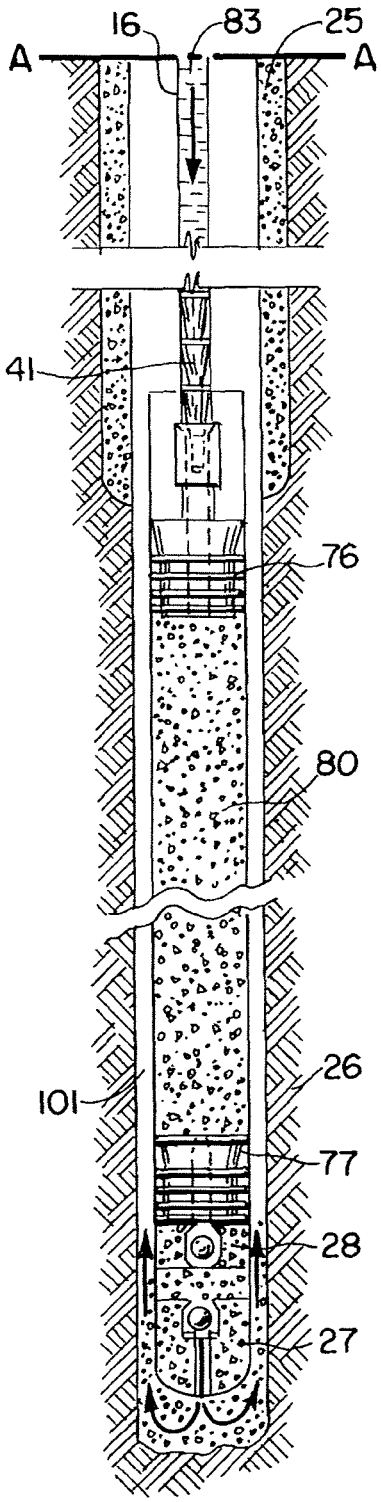
FIG. 14 is a sectional elevation view illustrating part of the method of the present invention and wherein line A-A of FIG. 14 matches line A-A of FIG. 9.
Figure 15:
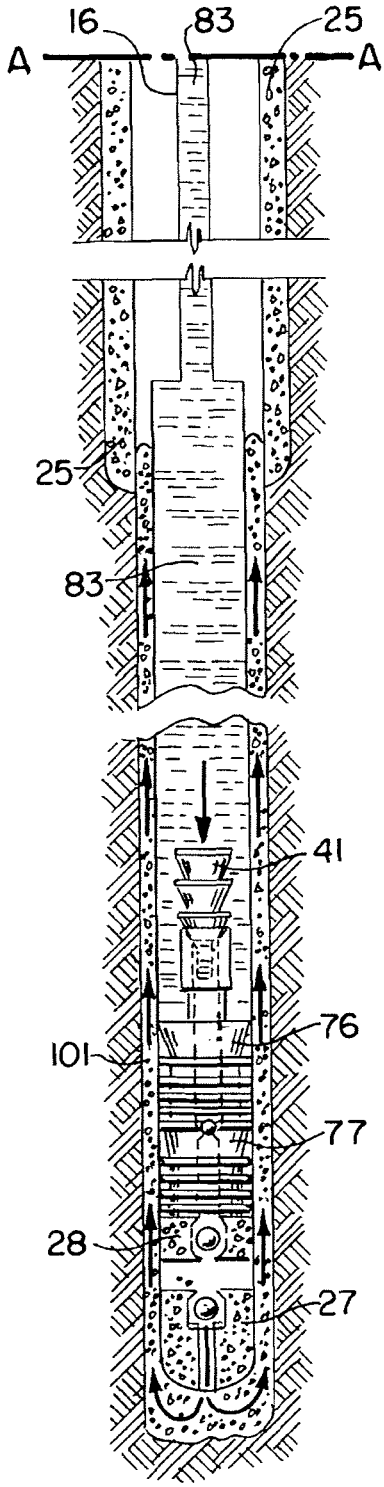
FIG. 15 is a sectional elevation view illustrating part of the method of the present invention and wherein line A-A of FIG. 15 matches line A-A of FIG. 9.
Figure 16:
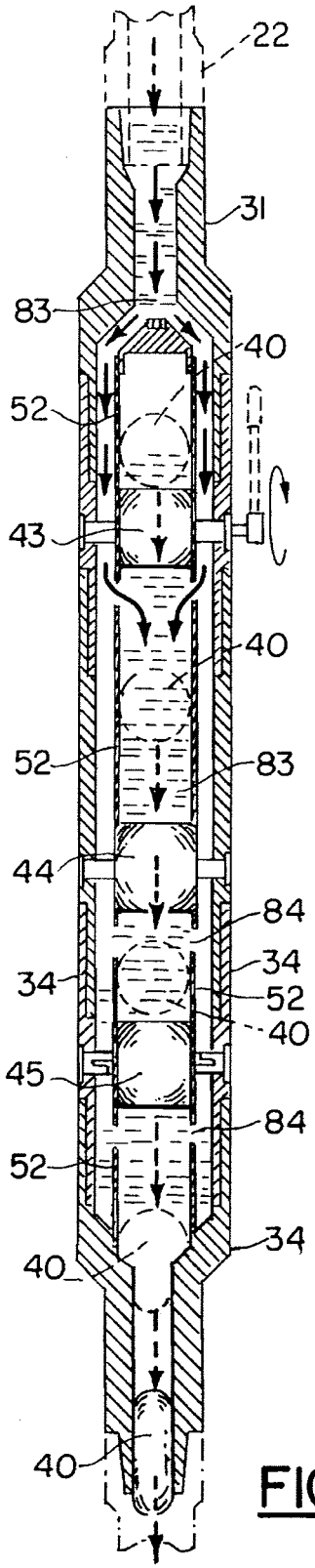
FIG. 16 is a sectional elevation view illustrating part of the method of the present invention.

When valve 44 is opened, dart 41 can be pumped downwardly to engage upper plug 76, registering upon it and closing its flow passage 79, pushing it downwardly as illustrated in FIGS. 14 and 15. Upper plug 79 and dart 41 are pumped downwardly using fluid 83 as illustrated in FIGS. 14 and 15. In FIG. 16, first valving member 43 is opened so that larger diameter ball 40 can move downwardly, pushing any remaining cement 80 downwardly.

The ball 40 can be deformable, so that it can enter the smaller diameter section 86 at the lower end portion of tool body 34. During this process, cement or like mixture 80 is forced downwardly through float collar 28 and casing shoe 27 into the space that is in between production casing and formation 26. This operation helps stabilize production casing 32 and prevents erosion of the surrounding formation 26 during drilling operations.

During drilling operations, a drill bit is lowered on a drill string using derrick 12, wherein the drill bit simply drills through the production casing 32 as it expands the well downwardly in search of oil.

Figure 20:
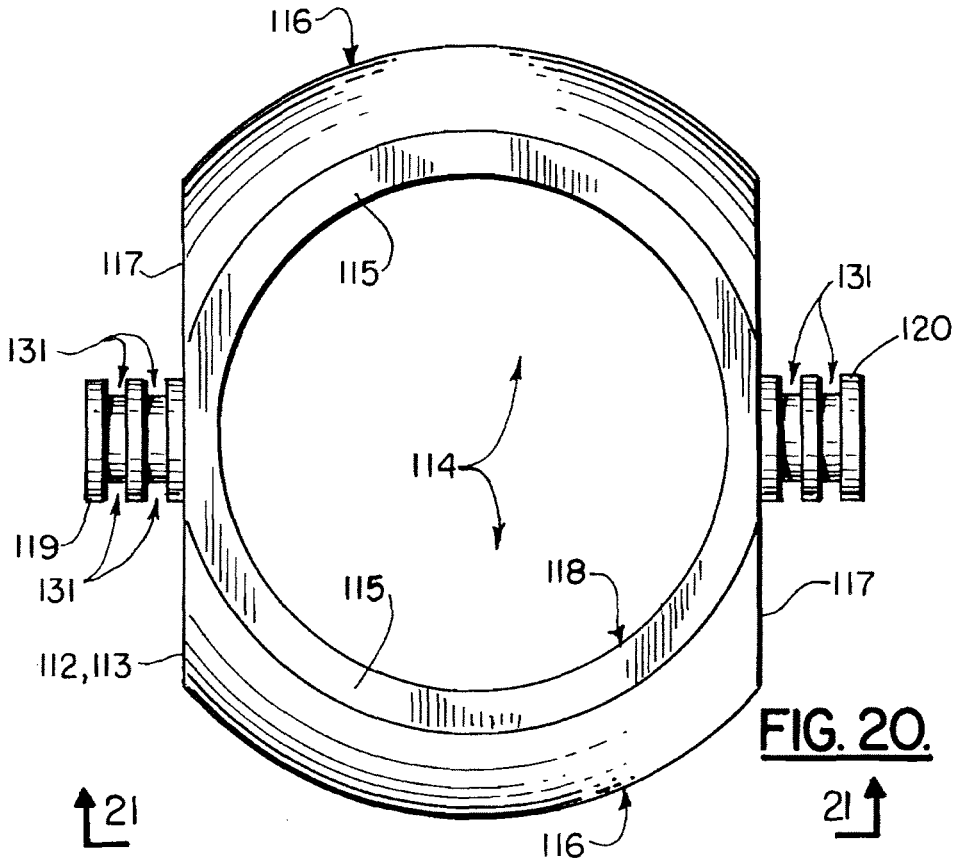
FIG. 20 is a partial view of a preferred embodiment of the apparatus of the present invention and showing a ball valving member.
Figure 21:
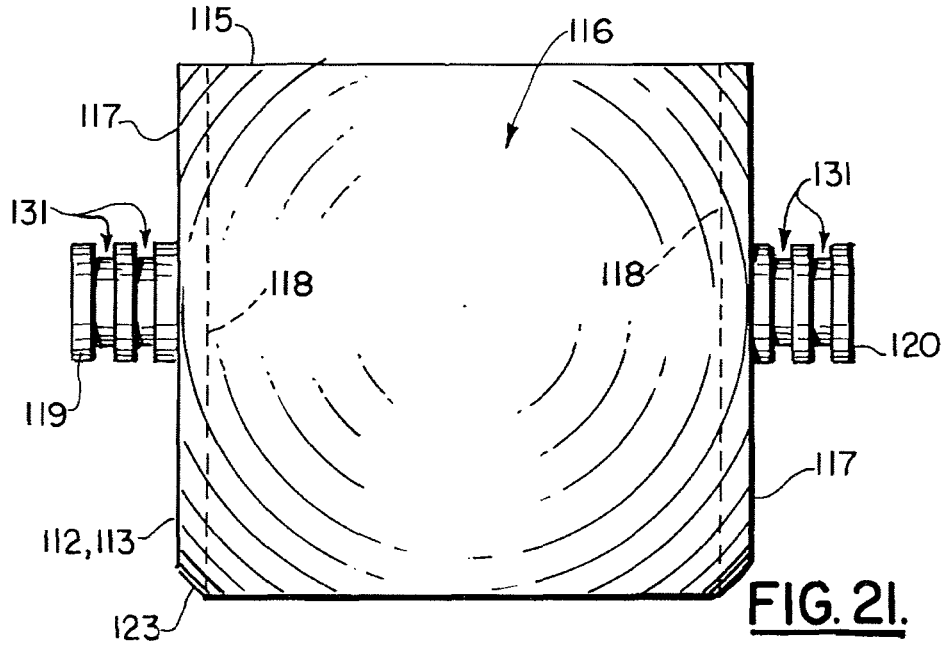
FIG. 21 is a partial side view of a preferred embodiment of the apparatus of the present invention and showing an alternate construction for the ball valving member.
Figure 22:
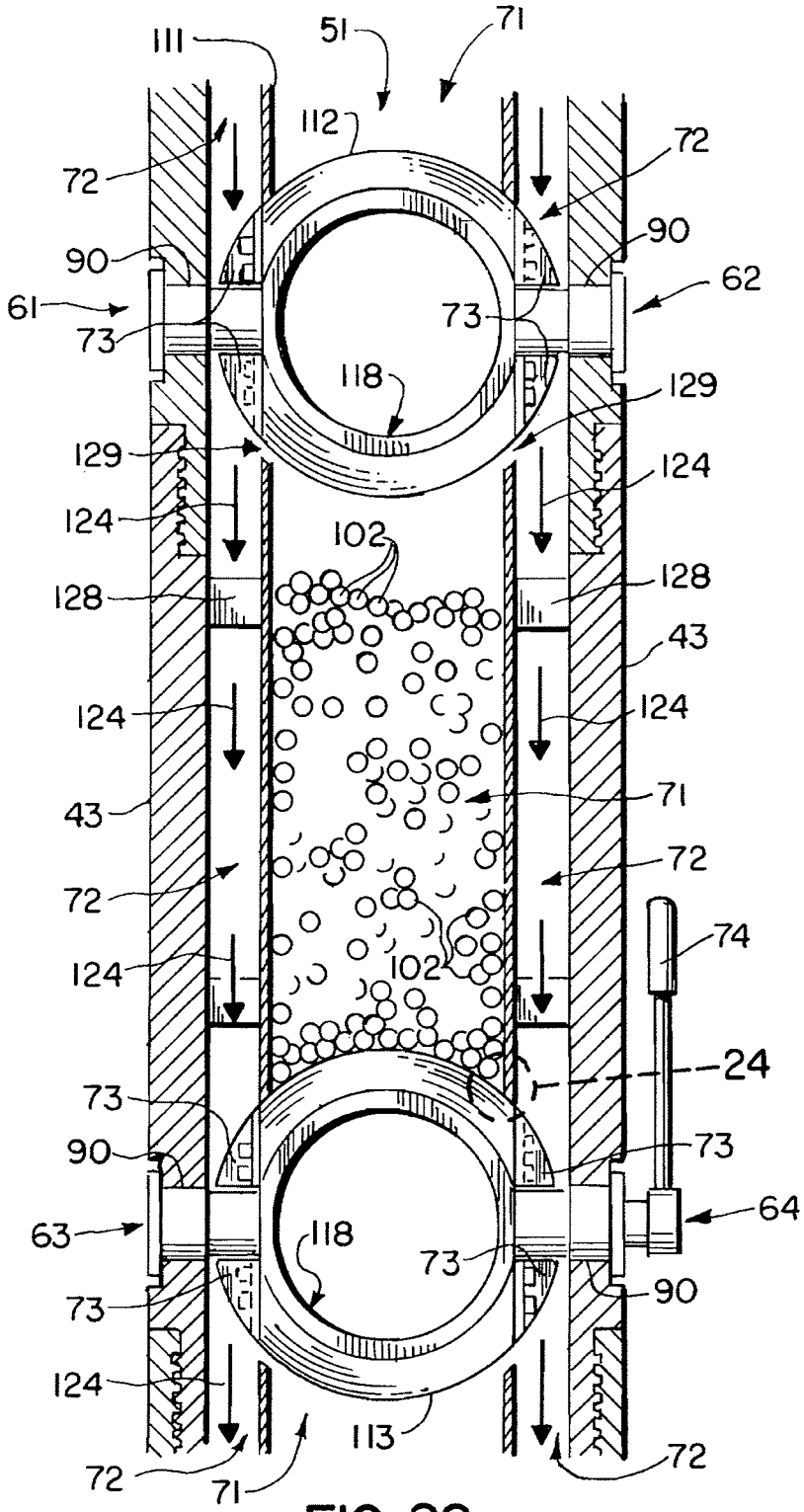
FIG. 22 is a sectional view of a preferred embodiment of the apparatus of the present invention showing an alternate sleeve arrangement.
Figure 23:
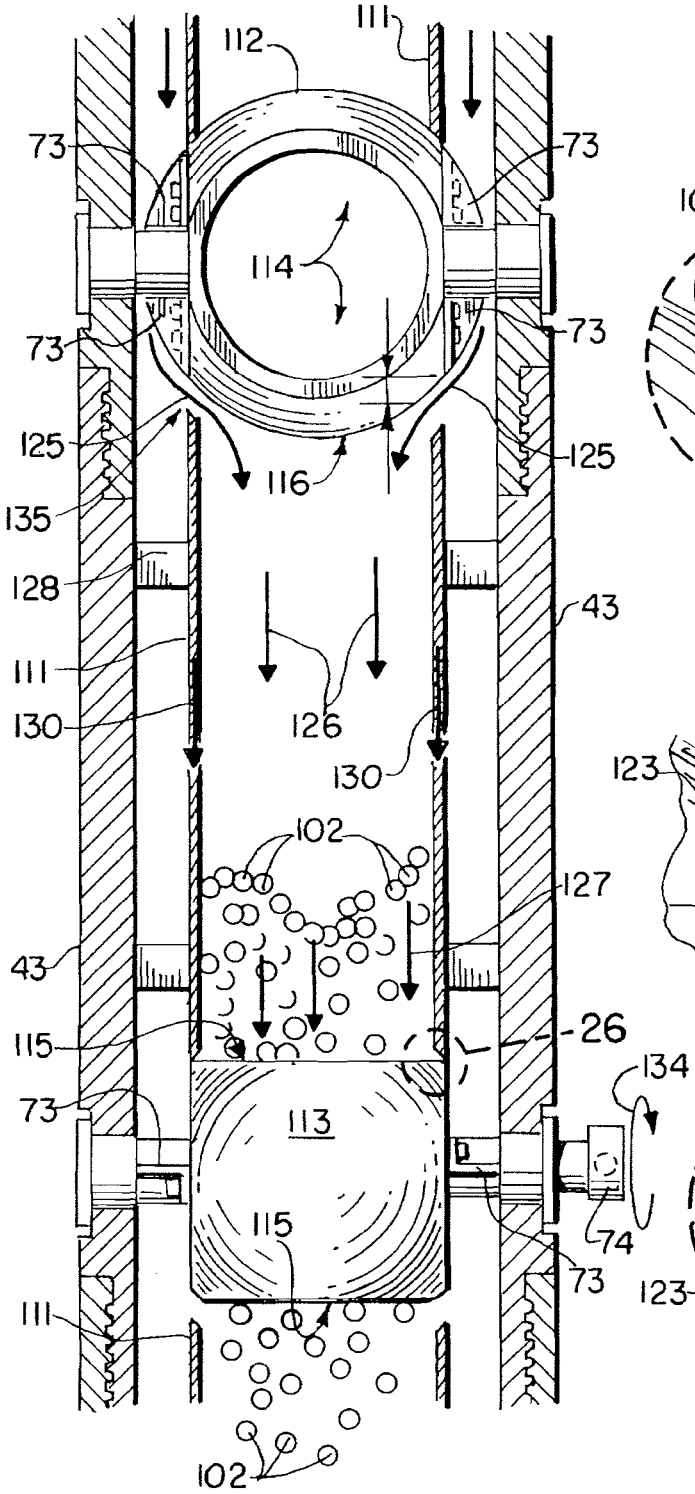
FIG. 23 is a sectional view of a preferred embodiment of the apparatus of the present invention showing an alternate sleeve arrangement.
Figure 24:
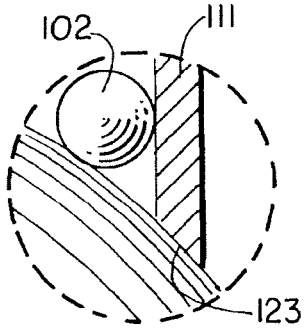
FIG. 24 is a fragmentary view of a preferred embodiment of the apparatus of the present invention.
Figure 25:
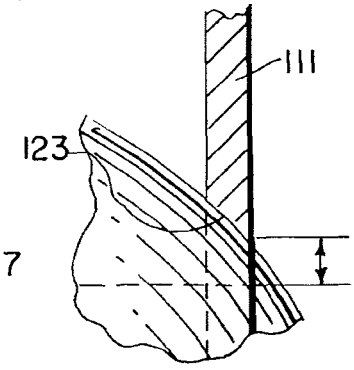
FIG. 25 is a fragmentary view of a preferred embodiment of the apparatus of the present invention.
Figure 26:
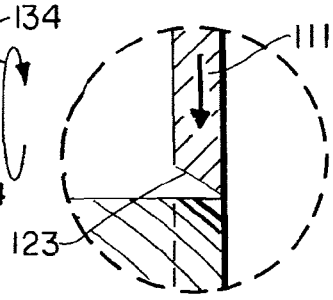
FIG. 26 is a fragmentary view of a preferred embodiment of the apparatus of the present invention.

FIGS. 18-26 show an alternate embodiment of the apparatus of the present invention, designated generally by the numeral 110 in FIGS. 22-23. In FIGS. 18-26, the flow openings 84 in sleeves 52 of ball/plug dropping head 110 of FIGS. 1-17 have been eliminated. Instead, sliding sleeves 111 are provided that move up or down responsive to movement of a selected valving member 112, 113. It should be understood that the same tool body 34 can be used with the embodiment of FIGS. 18-26, connected in the same manner shown in FIGS. 1-17 to tubular member 22 and string 16. In FIGS. 18-26, valving members 112, 113 replace the valving members 43, 44, 45 of FIGS. 1-17. In FIGS. 18-26, sleeves 111 replace sleeves 52. While two valving members 112, 113 are shown in FIGS. 22, 23, it should be understood that three such valving members (and a corresponding sleeve 111) could be employed, each valving member 112, 113 replacing a valving member 43, 44, 45 of FIGS. 1-17.

Figure 19:
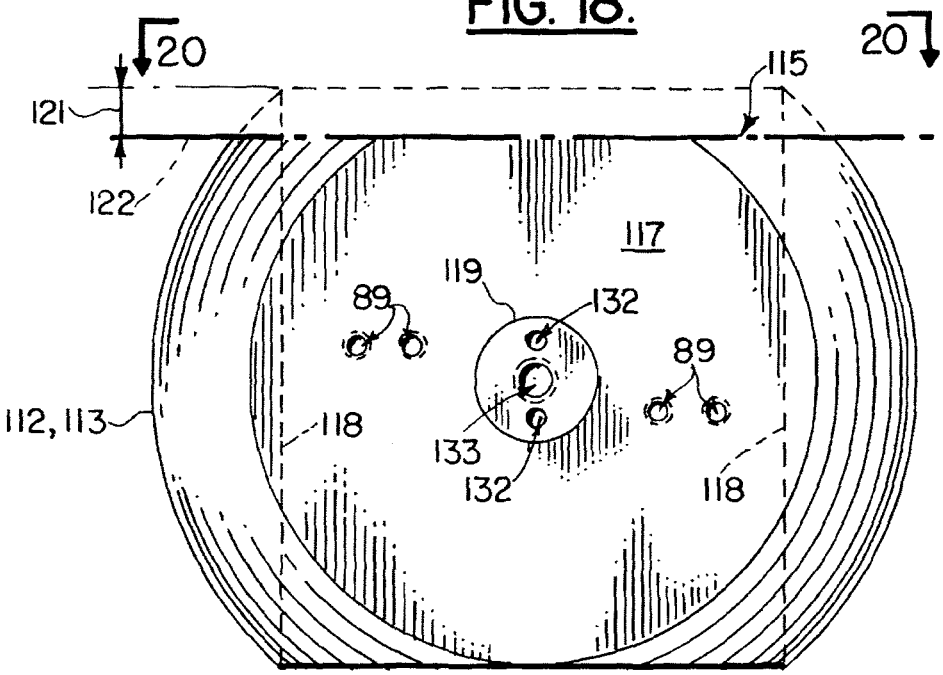
FIG. 19 is a partial side view of a preferred embodiment of the apparatus of the present invention and showing an alternate construction for the ball valving member.

In FIGS. 18-26, tool body 34 has upper and lower end portions 31, 33. As with a preferred embodiment of FIGS. 1-17, a flow bore 51 provides a central flow channel 71 and outer flow channel 72. Each valving member 112, 113 provides a valve opening 114. Each valving member 112, 113 provides a flat surface 115 (see FIG. 20). Each valving member 112, 113 provides a pair of opposed curved surfaces 116 as shown in FIG. 20 and a pair of opposed flat surfaces 117, each having a stem 119 or 120.

An internal, generally cylindrically shaped surface 118 surrounds valve opening 114 as shown in FIG. 20. Each valving member 112, 113 provides opposed stems 119, 120. Each valving member 112, 113 rotates between opened and closed positions by rotating upon stems 119, 120. Each of the stems 119, 120 is mounted in a stem opening 90 of tool body 34 at positions 61, 62 and 63, 64 as shown in FIG. 22.

In FIG. 19, valving member 122, 123 is similar in configuration and in sizing to the valving members 43, 44, of a preferred embodiment of FIGS. 1-17, with the exception of a portion that has been removed which is indicated in phantom lines in FIG. 19. The milled or cut-away portion of the valving member 112, 113 is indicated schematically by the arrow 121. Reference line 122 in FIG. 19 indicates the final shape of valving member 112, 113 after having been milled or cut. In FIGS. 20 and 21, a beveled edge at 123 is provided for each valving member 112, 113.

When a valving member 112, 113 is in the closed position of FIG. 22, flow arrows 124 indicate the flow of fluid through the tool body 34 bore 51 and more particularly in the outer channel 72 as indicated in FIG. 22.

In FIG. 23, the lower valving member 113 has been rotated to an open position as indicated schematically by the arrow 134, having been rotated with tool 74. In this position, fins 73 now block the flow of fluid in outer channel 72. Flat surface 115 now faces upwardly. In this position, the cut-away portion of valving member 113 that is indicated schematically by the arrow 121 in FIG. 19 now faces up. Sliding sleeve 111 drops downwardly as indicated schematically by arrows 130 when a valving member 112 or 113 is rotated to an open position (see valving member 113 in FIG. 23). In FIG. 22, a gap 129 was present in between upper valve 112 and sleeve 111 that is below the valve 112. The sleeve 111 that is in between the valves 112,113 is shown in FIG. 22 as being filled with very small diameter balls or "frac-balls" 102.

When valving member 113 is rotated to the open position of FIG. 23, the gap is now a larger gap, indicated as 135. Gap 135 (when compared to smaller gap 129) has become enlarged an amount equal to the distance 121 illustrated by arrow 121 in FIG. 19. The frac-balls 102 now drop through valving member 113 as illustrated by arrows 127 in FIG. 23. Arrows 125, 126 in FIG. 23 illustrate the flow of fluid downwardly through gap 135 and in central channel 71.

A sleeve 111 above a valving member 112 or 113 thus move up and down responsive to a rotation of that valving member 112 or 113. Spacers 28 can be employed that extend from each sleeve 111 radially to slidably engage tool body 34. In FIGS. 20 and 21, each stem 119, 120 can be provided with one or more annular grooves 131 that are receptive of o-rings 60 or other sealing material. As with a preferred embodiment of FIGS. 1-17, openings 132 in each stem 119, 120 are receptive of pins 99. Likewise, each stem 119, 120 provides internally threaded openings 133. Thus, the same connection for attaching a valving member 112, 113 to tool body 34 can be the one shown in FIGS. 1-17.

The following is a list of parts and materials suitable for use in the present invention.

PARTS LIST

| Part Number | Description |
|---|---|
| 10 | oil well drilling structure |
| 11 | platform |
| 12 | derrick |
| 13 | top drive unit |
| 14 | flow line |
| 15 | ball/plug dropping head |
| 16 | string |
| 17 | sea bed/mud line |
| 18 | body of water |
| 19 | water surface |
| 20 | platform deck |
| 21 | lifting device |
| 22 | tubular member |
| 23 | well bore |
| 24 | surface casing |
| 25 | cement/concrete |
| 26 | formation |
| 27 | casing shoe |
| 28 | float valve |
| 29 | passageway |
| 30 | passageway |
| 31 | upper end |
| 32 | liner/production casing |
| 33 | lower end portion |
| 34 | tool body |
| 35 | section |
| 36 | section |
| 37 | section |
| 38 | section |
| 39 | section |
| 40 | larger diameter ball |
| 41 | dart |
| 42 | smaller diameter ball |
| 43 | first valving member |
| 44 | second valving member |
| 45 | third valving member |
| 46 | threaded connection |
| 47 | threaded connection |
| 48 | threaded connection |
| 49 | threaded connection |
| 50 | threaded portion |
| 51 | flow bore |
| 52 | sleeve |
| 53 | channel |
| 54 | stem |
| 55 | stem |
| 56 | sleeve |
| 57 | sleeve |
| 58 | plug |
| 59 | plug |
| 60 | o-ring |
| 61 | opening position |
| 62 | opening position |
| 63 | opening position |
| 64 | opening position |
| 65 | opening position |
| 66 | opening position |
| 67 | spacer |
| 68 | outer curved surface |
| 69 | flat surface |
| 70 | flat surface |
| 71 | central flow channel |
| 72 | outer flow channel |
| 73 | fin |
| 74 | tool |
| 75 | arrow |
| 76 | upper plug |
| 77 | lower plug |

-continued

PARTS LIST

| Part Number | Description |
|---|---|
| 78 | arrows |
| 79 | flow passage |
| 80 | cement |
| 81 | flow passage |
| 82 | arrow |
| 83 | fluid |
| 84 | opening |
| 85 | opening |
| 86 | smaller diameter section |
| 87 | arrow - fluid flow path |
| 88 | fastener |
| 89 | internally threaded opening |
| 90 | opening |
| 91 | fastener |
| 92 | bushing |
| 93 | external threads |
| 94 | sleeve |
| 95 | passageway/bore |
| 96 | fastener |
| 97 | internally threaded opening |
| 98 | opening |
| 99 | pin |
| 100 | arrows |
| 101 | space |
| 102 | frac-ball |
| 110 | ball/plug dropping head |
| 111 | sleeve |
| 112 | valving member |
| 113 | valving member |
| 114 | valve opening |
| 115 | flat surface |
| 116 | curved surface |
| 117 | flat surface |
| 118 | internal surface |
| 119 | stem |
| 120 | stem |
| 121 | arrow |
| 122 | reference line |
| 123 | beveled edge |
| 124 | arrow |
| 125 | arrow |
| 126 | arrow |
| 127 | arrow |
| 128 | spacer |
| 129 | smaller gap |
| 130 | arrow sleeve movement |
| 131 | annular groove |
| 132 | opening |
| 133 | internally threaded opening |
| 134 | arrow |
| 135 | larger gap |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A ball and plug dropping head for use in sequentially dropping one or more balls and plugs into a well tubing, comprising:

a) a housing having an inlet at its upper end adapted to be fluidly connected in line with the lower end of a top drive, an outlet generally aligned with the inlet;

b) a main flow channel that connects the inlet and the outlet;

c) a plurality of inner valving members spaced between the inlet and the outlet, each valving member having an inner valve flow bore, and being movable upon a valve stem between open and closed positions;

d) one or more bypass fluid flow channels that enable fluid to bypass the inner valving members when a said inner valving member is in the closed position;

e) at least one of the inner valving members having a cross section that, in the closed position, does not valve fluid flow in the main flow channel;

f) wherein fluid flow in the main channel flows around the inner valving member via the bypass fluid flow channel when it is in the closed position and through the inner valving member when it is in the open position;

g) wherein in the open position each inner valve flow bore permits a ball or plug to pass therethrough, and circulating fluid to pass downwardly therethrough when neither a ball nor plug is in the valve flow bore;

h) one or more outer valving members mounted on the valve stem and that each occupy a position in the bypass channel;

i) wherein the outer valving member opens the bypass channel when the inner valving member is in the closed position; and j) wherein the outer valving member closes the bypass channel when the inner valving member is in the open position.

2. The ball and plug dropping head of claim 1, wherein at least one valve has a pair of opposed, generally flat surfaces.

3. The ball and plug dropping head of claim 1, wherein at least one valving member has a valve opening that enables passage of a plug of a diameter of 6.5 inches.

4. The ball and plug dropping head of claim 1, wherein at least one valving member in the closed position has a generally cylindrically shaped cross section.

5. The ball and plug dropping head of claim 1, wherein at least one valving member in the closed position has a generally rectangular shaped cross section.

6. The ball and plug dropping head of claim 1, wherein the body has a working tension of two million pounds.

7. The ball and plug dropping head of claim 1, wherein the body has an internal working pressure of 15,000 psi.

8. The ball and plug dropping head of claim 1, wherein the body has a working torque of 50,000 foot pounds.

9. The ball and plug dropping head of claim 8, wherein the body has a working torque of 50,000 foot pounds in either of two rotational directions.

10. The ball and plug dropping head of claim 1, wherein there are multiple valving members that enable fluid flow around the valving member when the valving member is closed.

11. The method of claim 1, further comprising enabling fluid to flow around the inner valving member via the outer channel and the outer valving member is opened, and wherein both inner and outer valving members are mounted to and rotate with a common valve stem when the inner valving member is closed.

12. A ball and plug dropping head for use in sequentially dropping one or more balls and plugs into a well tubing, comprising:

a) a housing having an inlet at its upper end adapted to be fluidly connected in line with the lower end of a top drive, an outlet generally aligned with the inlet;

b) a main flow channel that connects the inlet and the outlet, and including an inner channel and an outer channel;

c) a plurality of valving members spaced between the inlet and the outlet, each valving member having a valve stem, a valve inner part with a flow bore, a valve outer part, and being movable between open and closed positions;

d) the outer channel enabling fluid to bypass a valving member inner part when a valving member inner part is in the closed position;

e) at least one of the valving members having said inner part with a cross section that, in the open position, does not valve fluid flow in the main flow channel;

f) wherein fluid flow flows around the valving member inner part via the outer channel when said inner part is in the closed position and through the valving member inner part and the inner channel when the valve inner part is in the open position;

g) wherein each valving member inner part is configured to support a ball or plug when closed;

h) wherein in the open position each inner part flow bore permits a ball or plug to pass therethrough, and circulating fluid to pass downwardly therethrough when neither a ball nor plug is in the inner part flow bore;

i) the valve outer part movable between first and second positions, the first position enabling flow via the outer channel when the inner channel is closed by the inner part; and j) the second position closing the outer channel when the inner channel is open.

13. The ball and plug dropping head of claim 12, wherein at least one valve has a pair of opposed, generally flat surfaces.

14. The ball and plug dropping head of claim 12, wherein at least one valving member has a valve opening that enables passage of a plug of a diameter of 6.5 inches.

15. The ball and plug dropping head of claim 12, wherein at least one valving member in the closed position has a generally cylindrically shaped cross section.

16. The ball and plug dropping head of claim 12, wherein at least one valving member in the closed position has a generally rectangular shaped cross section.

17. The ball and plug dropping head of claim 12, wherein the body has a working tension of two million pounds.

18. The ball and plug dropping head of claim 12, wherein the body has an internal working pressure of 15,000 psi.

19. The ball and plug dropping head of claim 12, wherein the body has a working torque of 50,000 foot pounds.

20. The ball and plug dropping head of claim 19, wherein the body has a working torque of 50,000 foot pounds in either of two rotational directions.

21. The ball and plug dropping head of claim 12, wherein there are multiple valving members that enable fluid flow around the valving member when the valving member is closed.

22. A ball and plug dropping head for use in sequentially dropping one or more balls and plugs into a well tubing, comprising:

a) a housing having an inlet at its upper end adapted to be fluidly connected in line with the lower end of a top drive, an outlet generally aligned with the inlet;

b) a main flow channel that connects the inlet and the outlet;

c) a plurality of vertically sliding sleeves that divide the main channel into inner and outer channels;

d) a plurality of valving members spaced between the inlet and the outlet, each valving member having an inner part with a flow bore, and being movable between open and closed positions;

e) the outer channel enabling fluid to bypass the valving members when a valving member inner part is in the closed position;

f) at least one of the valving members having a curved surface that closes the inner but not the outer channel in a closed position and wherein in the open position the valving member opening generally aligns with the inner channel;

g) wherein fluid flow in the main channel flows around the valving member inner part when it is in the closed position and through the valving member inner part when it is in the open position;

h) wherein each valving member inner part is configured to support a ball or plug when closed;

i) wherein in the open position each valve flow bore permits a ball or plug to pass therethrough, and circulating fluid to pass downwardly therethrough when neither a ball nor plug is in the valve flow bore; and j) one or more of the valving members having an outer part that closes the outer channel when the inner part opens the inner channel.

23. A method of sequentially dropping one or more balls, darts or plugs into an oil and gas well tubing, comprising the steps of:

a) providing a housing having an inlet at its upper end adapted to be fluidly connected in line with the lower end of a top drive, an outlet generally aligned with the inlet, an inner flow channel that connects the inlet and the outlet and a plurality of inner valving members spaced between the inlet and the outlet, each inner valving member having a flow bore, and being movable between open and closed positions;

b) enabling fluid to bypass the inner valving members via an outer channel when a said inner valving member is in the closed position;

c) preventing fluid flow in the inner flow channel when a said inner valving member is in a closed position;

d) enabling fluid flow around a said inner valving member via the outer channel when the inner valving member is in the closed position and through the said inner valving member when the inner valving member is in the open position;

e) supporting a ball or plug with a said inner valving member when the said inner valving member is closed;

f) permitting a ball or plug to pass through a said inner valving member when the valving member is in the open position; and g) closing the outer channel with an outer valving member when the inner channel is opened with an inner valving member.

24. The method of claim 23, wherein the outer valving member has a plurality of opposed, generally flat surfaces.

25. The method of claim 23, wherein at least one inner valving member has a valve opening that enables passage of a plug of a diameter of 6.5 inches.

26. The method of claim 23, wherein at least one inner valving member in the closed position has a generally cylindrically shaped cross section.

27. The method of claim 23, wherein at least one inner valving member in the closed position has a generally rectangular shaped cross section.

28. The method of claim 23, wherein the body has a working tension of two million pounds.

29. The method of claim 23, wherein the body has an internal working pressure of 15,000 psi.

30. The method of claim 23, wherein the body has a working torque of 50,000 foot pounds.

31. The ball and plug dropping head of claim 30, wherein the body has a working torque of 50,000 foot pounds in either of two rotational directions.

32. A method of dropping one or more balls or plugs into a well tubing, comprising:

a) providing a housing having an inlet at its upper end adapted to be fluidly connected in line with the lower end of a top drive, an outlet generally aligned with the inlet, an inner flow channel that connects the inlet and the outlet, an outer flow channel, a plurality of sleeves that separate the inner channel from the outer channel, a plurality of inner valving members spaced between the inlet and the outlet, each inner valving member having a flow bore, and being movable between open and closed positions;

b) enabling fluid to bypass the inner valving members via the outer flow channel when an inner valving member is in the closed position;

c) flowing fluid in the outer channel and around an inner valving member when an inner valving member is in the closed position and through a said inner valving member via the inner channel when the inner valving member is in the open position;

d) supporting a ball or plug with a said inner valving member when the said inner valving member is closed; and e) permitting a ball or plug to pass a said inner valving member when it is open.

33. A ball and plug dropping head for use in sequentially dropping one or more balls and plugs into a well tubing, comprising:

a) a housing having an inlet at its upper end adapted to be fluidly connected in line with the lower end of a top drive, an outlet generally aligned with the inlet;

b) a main flow channel that connects the inlet and the outlet;

c) a plurality of valving members spaced between the inlet and the outlet, each valving member having a valve inner part with a flow bore, a valve outer part, and a valve stem, wherein each said inner part rotates on said stem with a said outer part between first and second positions;

d) one or more bypass fluid flow channels that enable fluid to bypass a said valve inner part when a said inner part is in the closed position;

e) wherein at least one of the valve inner parts does not stop fluid flow in the main flow channel in said first position;

f) wherein fluid flows around the said inner part via the bypass fluid flow channel when the said inner part is in the second position;

g) wherein in the first position the main flow bore permits a ball or plug to pass therethrough, and circulating fluid to pass downwardly therethrough when neither a ball nor plug is in the main flow channel;

h) the valving member outer part occupying a position in the bypass channel; and i) wherein the valve outer part closes the bypass channel in the first position and opens the bypass channel in the second position.

34. A method of sequentially dropping one or more balls, darts or plugs into an oil and gas well tubing, comprising the steps of:

a) providing a housing having an inlet at its upper end adapted to be fluidly connected in line with the lower end of a top drive, an outlet generally aligned with the inlet, a main flow channel that connects the inlet and the outlet and a plurality of valving members spaced between the inlet and the outlet, each valving member having an inner part with a flow bore, a valve stem, and an outer part, said inner and outer valve parts being movable upon said stem between first and second positions;

b) providing a bypass channel and enabling fluid to bypass the valve inner part via the bypass channel when the valve inner part is in the first position;

c) preventing fluid flow in the main flow channel when the valving member inner part is in the first position;

d) enabling fluid flow through the valving member inner part when the valving member inner part is in the second position;

e) supporting a ball or plug with a valving member when the valving member inner part is in the first position;

f) permitting a ball or plug to pass through the valving member inner part when the valving member inner part is in the second position; and g) wherein the valve outer part closes the bypass channel in the first position and opens the bypass channel in the second position.

* * * * *